US008636610B2

(12) United States Patent
Golden et al.

(10) Patent No.: US 8,636,610 B2
(45) Date of Patent: Jan. 28, 2014

(54) METAL WOOD CLUB WITH IMPROVED MOMENT OF INERTIA

(75) Inventors: Charles E. Golden, Encinitas, CA (US); Noah De La Cruz, San Clemente, CA (US); Daniel S. Callinan, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 13/600,276

(22) Filed: Aug. 31, 2012

(65) Prior Publication Data

US 2012/0322579 A1 Dec. 20, 2012

Related U.S. Application Data

(62) Division of application No. 11/952,220, filed on Dec. 7, 2007, now abandoned.

(51) Int. Cl.
*A63B 53/00* (2006.01)

(52) U.S. Cl.
USPC ..... 473/349; 473/324; 473/345; D21/752

(58) Field of Classification Search
USPC ..... 473/349–350, 324, 345; D21/752
See application file for complete search history.

(56) References Cited

U.S. PATENT DOCUMENTS

| | | | | | |
|---|---|---|---|---|---|
| 863,728 | A | | 8/1907 | Legh | |
| 1,349,806 | A | * | 8/1920 | Booth | 473/344 |
| 1,868,286 | A | * | 7/1932 | Grieve | 473/328 |
| 2,880,002 | A | | 3/1959 | Wetly | |
| 3,166,320 | A | * | 1/1965 | Onions | 473/314 |
| D239,964 | S | * | 5/1976 | Wilson | D21/733 |
| 4,420,156 | A | | 12/1983 | Campau | |
| D275,412 | S | * | 9/1984 | Simmons | D21/752 |
| D275,590 | S | * | 9/1984 | Duclos | D21/733 |
| 4,775,156 | A | * | 10/1988 | Thompson | 473/328 |
| 4,877,249 | A | * | 10/1989 | Thompson | 473/349 |
| 5,272,802 | A | * | 12/1993 | Stites, III | 29/527.2 |
| 5,547,188 | A | * | 8/1996 | Dumontier et al. | 473/287 |
| 5,573,469 | A | * | 11/1996 | Dekura | 473/314 |
| 5,755,624 | A | | 5/1998 | Helmstetter | |
| 5,989,134 | A | * | 11/1999 | Antonious | 473/327 |
| 6,123,627 | A | | 9/2000 | Antonious | |
| D438,277 | S | | 2/2001 | Hasebe et al. | |
| 6,254,494 | B1 | | 7/2001 | Hasebe et al. | |
| 6,340,337 | B2 | | 1/2002 | Hasebe et al. | |
| 6,425,832 | B2 | | 7/2002 | Cackett et al. | |
| 6,572,491 | B2 | | 6/2003 | Hasebe et al. | |
| 6,607,452 | B2 | | 8/2003 | Helmstetter et al. | |
| D479,867 | S | * | 9/2003 | Saliba et al. | D21/752 |

(Continued)

*Primary Examiner* — Gene Kim
*Assistant Examiner* — Matthew B Stanczak
(74) *Attorney, Agent, or Firm* — Randy K. Chang

(57) ABSTRACT

A golf club head having at least two discrete weight members positioned on the sole to optimize moment of inertia is disclosed. A first weight member is located toward and substantially parallel with the face edge of the sole. A second member is located toward the back of the sole and substantially centered between the heel and toe edges of the sole. In one embodiment, a golf club head includes a sole comprising four sections and wherein a rib of material connects two of said sections. In another embodiment, a golf club head includes a cavity formed between the crown and sole and having an opening at the back of the club head. In yet another embodiment, a golf club head is tapered to form a waist and has a back that has a bowed-shape.

2 Claims, 21 Drawing Sheets

(56) References Cited

U.S. PATENT DOCUMENTS

| | | | | |
|---|---|---|---|---|
| 6,743,119 | B2 | 6/2004 | Lo | |
| D492,745 | S | 7/2004 | Tang | |
| 6,776,723 | B2 | 8/2004 | Bliss et al. | |
| D498,508 | S * | 11/2004 | Antonious | D21/752 |
| 6,855,068 | B2 * | 2/2005 | Antonious | 473/327 |
| 6,945,877 | B2 | 9/2005 | Kobayashi et al. | |
| D523,509 | S | 6/2006 | Soracco et al. | |
| D524,890 | S | 7/2006 | Foster et al. | |
| D526,039 | S | 8/2006 | Breier et al. | |
| D528,619 | S | 9/2006 | Tang et al. | |
| D538,867 | S | 3/2007 | Cleveland et al. | |
| D544,558 | S | 6/2007 | Oldknow | |
| D554,719 | S | 11/2007 | Barez et al. | |
| D555,745 | S * | 11/2007 | Rollinson et al. | D21/759 |
| D567,888 | S * | 4/2008 | Soracco | D21/752 |
| 7,540,812 | B2 | 6/2009 | Imamoto et al. | |
| 7,658,686 | B2 * | 2/2010 | Soracco | 473/342 |
| 7,980,964 | B2 * | 7/2011 | Soracco | 473/334 |
| 8,007,371 | B2 * | 8/2011 | Breier et al. | 473/342 |
| 8,025,591 | B2 * | 9/2011 | De La Cruz et al. | 473/344 |
| 8,038,545 | B2 * | 10/2011 | Soracco | 473/345 |
| 8,226,499 | B2 * | 7/2012 | Soracco | 473/334 |
| 2001/0007837 | A1 * | 7/2001 | Hasebe et al. | 473/349 |
| 2004/0018891 | A1 | 1/2004 | Antonious | |
| 2005/0043115 | A1 | 2/2005 | Lin | |
| 2005/0049081 | A1 | 3/2005 | Boone | |
| 2006/0019770 | A1 | 1/2006 | Meyer et al. | |
| 2006/0148586 | A1 | 7/2006 | Williams et al. | |
| 2006/0240909 | A1 * | 10/2006 | Breier et al. | 473/334 |
| 2006/0240910 | A1 | 10/2006 | Soracco | |
| 2007/0054751 | A1 * | 3/2007 | Breier et al. | 473/334 |
| 2007/0129167 | A1 * | 6/2007 | Matsunaga | 473/345 |
| 2007/0298903 | A1 | 12/2007 | Stites et al. | |
| 2008/0039228 | A1 * | 2/2008 | Breier et al. | 473/334 |
| 2008/0090676 | A1 * | 4/2008 | Matsunaga et al. | 473/350 |
| 2009/0105010 | A1 * | 4/2009 | De La Cruz et al. | 473/345 |
| 2010/0130304 | A1 * | 5/2010 | Soracco | 473/345 |
| 2010/0130305 | A1 * | 5/2010 | Soracco | 473/345 |
| 2011/0275455 | A1 * | 11/2011 | Soracco | 473/345 |
| 2012/0058839 | A1 * | 3/2012 | De La Cruz et al. | 473/345 |
| 2013/0102414 | A1 * | 4/2013 | De La Cruz et al. | 473/345 |

* cited by examiner

METAL WOOD CLUB WITH IMPROVED MOMENT OF INERTIA

CROSS REFERENCE TO RELATED APPLICATIONS

The present application is a Divisional of U.S. patent application Ser. No. 11/952,220, filed on Dec. 7, 2007 now abandoned, the disclosure of which is incorporated by reference in its entirety.

FIELD OF THE INVENTION

The present invention relates to an improved metal wood golf club head. More particularly, the present invention relates to a driver, hybrid or utility-style hollow golf club head with an optimized moment of inertia.

BACKGROUND OF THE INVENTION

The complexities of golf club design are known. The specifications for each component of the club (i.e., the club head, shaft, grip, and subcomponents thereof) directly impact the performance of the club. Thus, by varying the design specifications, a golf club can be tailored to have specific performance characteristics.

The design of club heads has long been studied. Among the more prominent considerations in club head design are loft, lie, face angle, horizontal face bulge, vertical face roll, center of gravity, rotational moment of inertia, material selection, and overall head weight. While this basic set of criteria is generally the focus of golf club designers, several other design aspects must also be addressed. The interior design of the club head may be tailored to achieve particular characteristics, such as the inclusion of a hosel or a shaft attachment means, perimeter weights on the club head, and fillers within the hollow club heads.

Golf club heads must also be strong to withstand the repeated impacts that occur during collisions between the golf club and the golf balls. The loading that occurs during this transient event can create a peak force of over 2,000 lbs. Thus, a major challenge is to design the club face and club body to resist permanent deformation or failure by material yield or fracture. Conventional hollow metal wood drivers made from titanium typically have a uniform face thickness exceeding 2.5 mm or 0.10 inch to ensure structural integrity of the club head.

Players generally seek a metal wood driver and golf ball combination that delivers maximum distance and landing accuracy. The distance a ball travels after impact is dictated by the magnitude and direction of the ball's initial velocity and the ball's rotational velocity or spin. Environmental conditions, including atmospheric pressure, humidity, temperature, and wind speed, further influence the ball's flight. However, these environmental effects are beyond the control of the golf equipment designers. Golf ball landing accuracy is driven by a number of factors as well. Some of these factors are attributed to club head design, such as center of gravity and moment of inertia.

Concerned that improvements to golf equipment may render the game less challenging, the United States Golf Association (USGA), the governing body for the rules of golf in the United States, has specifications for the performance of golf equipment. These performance specifications dictate the size and weight of a conforming golf ball or a conforming golf club. USGA rules limit a number of parameters for drivers. For example, the volume of drivers has been limited to 460±10 cubic centimeters. The length of the shaft, except for putter, has been capped at 48 inches. The driver clubs have to fit inside a 5-inch square and the height from the sole to the crown cannot exceed 2.8 inches. The USGA has further limited the coefficient of restitution of the impact between a driver and a golf ball to 0.830.

The USGA has also observed that the rotational moment of inertia of drivers, or the club's resistance to twisting on off-center hits, has tripled from about 1990 to 2005, which coincides with the introduction of oversize drivers. Since drivers with higher rotational moment of inertia are more forgiving on off-center hits, the USGA was concerned that further increases in the club head's inertia may reduce the challenge of the game, and instituted in 2006 a limit on the moment of inertia for drivers at 5900 $g\cdot cm^2 \pm 100$ $g\cdot cm^2$ or 32.259 $oz\cdot in^2 \pm 0.547$ $oz\cdot in^2$. The limit on the moment of inertia is to be measured around a vertical axis, the y-axis as used herein, through the center of gravity of the club head.

A number of patent references have disclosed driver clubs with high moment of inertia, such as U.S. Pat. Nos. 6,607,452 and 6,425,832. These driver clubs use a circular weight strip disposed around the perimeter of the club body away from the hitting face to obtain a moment of inertia from 2800 to 5000 $g\cdot cm^2$ about the vertical axis. U.S. Pat. App. Pub. No. 2006/0148586 A1 discloses driver clubs with moment of inertia in the vertical direction from 3500 to 6000 $g\cdot cm^2$. However, the '586 application limits the shape of the driver club to be substantially square when viewed from the top, which in turn limits the mass characteristics of the club head.

However, most oversize drivers on the market at this time have moments of inertia in the range of about 4,000 to 4,300 $g\cdot cm^2$. Hence, there remains a need for more forgiving driver, hybrid and utility hollow golf club heads with optimized moments of inertia.

BRIEF SUMMARY OF THE INVENTION

The present invention is directed to a golf club head having a substantially I-beam-shaped mass distribution. More preferably, the present invention is directed to a driver, hybrid or utility hollow golf club head having a mass distribution that substantially resembles an I-beam or pseudo-I-beam to optimize the moment of inertia of the club head around the y-axis.

The golf club head of the present invention includes two discrete weight members, one located on the sole toward the face and one located on the sole toward the back. Said sole weight members may have greater density or thickness than the surrounding sole material. Alternatively, said weight members may comprise weights disposed on the surface of the sole. By placing mass in two discrete locations on the sole located away from the vertical axis that runs through the center of gravity of the club head, the rotational inertia of the club head about that axis is increased relative to a configuration in which mass is evenly spread around the sole.

In accordance with this invention, the club head may have a multitude of different shapes, although in each embodiment, weight is concentrated in distinct areas locations on the sole—at least one weight member is located on the sole toward the face and at least one weight member is located on the sole toward the back. According to an aspect of this invention, the weight member on the sole and toward the face may be divided into two zones of mass, and likewise the weight member on the sole and toward the back may be divided into two zones of mass.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

Rotational moment of inertia ("MOI" or "inertia") in golf clubs is well known in the art, and is fully discussed in many references, including U.S. Pat. No. 4,420,156, which is incorporated herein by reference in its entirety. When the inertia is too low, the club head tends to rotate excessively from off-center hits. A golf club head having a higher moment of inertia will resist rotation due to an off-center impact between the club face and a golf ball, thereby mitigating the tendency for the ball to hook or slice and increasing flight distance and landing accuracy. The present invention is directed to a hollow body golf club head having discrete concentrations of weight or mass located away from the center of gravity or the geometric center of the club head to optimize the moment of inertia of the club head about the vertical axis running through the center of gravity, hereinafter called the y-axis. In particular, the present invention is directed to a hollow body driver, hybrid or utility golf club head having the above-described mass characteristics.

Figure 1:
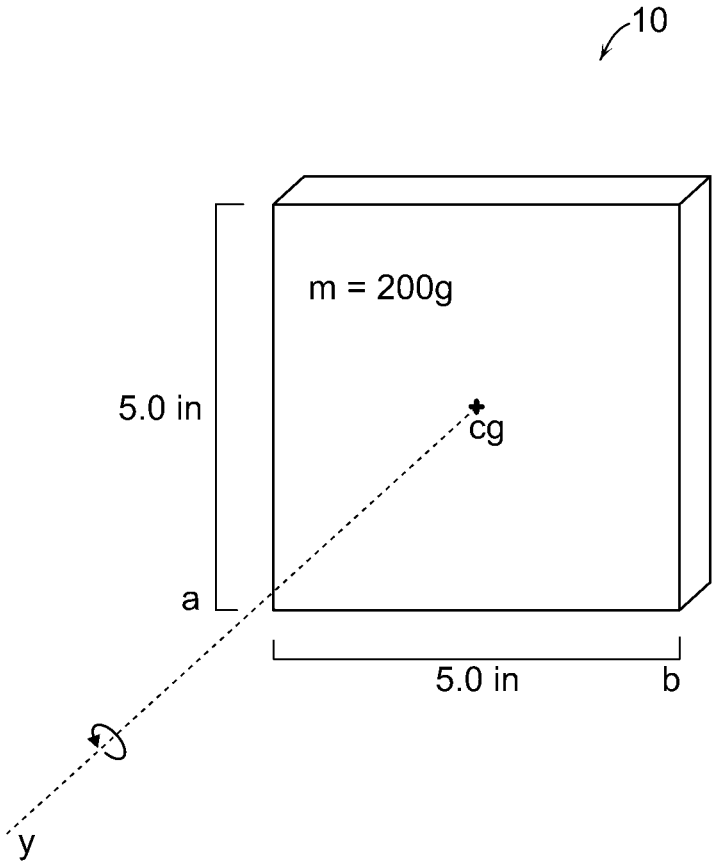
FIG. 1 is a top, perspective view of an idealized club head.

As is shown in FIG. 1, idealized club head 10 having an evenly-distributed mass m of 200 grams and sides a and b five inches in length, fitting into the USGA-prescribed five-inch box, will have a center of gravity at its center of mass. For objects rotating about a known axis of rotation, moment of inertia I can be calculated using the following equation:

$$I=mr^2$$

where m is the mass of the object and r is the distance of that mass from the axis of rotation.

The moment of inertia of club head 10 about the y-axis can be described by this equation:

$$I=\tfrac{1}{12}\cdot m(a^2+b^2)$$

Using this equation, the moment of inertia of club head 10 is 833.33 g·in$^2$ or 5376.33 g·cm$^2$. Because the mass of club head 10 is evenly distributed, the individual point masses located near the y-axis do not contribute great amounts of inertia to the overall inertia of the club head, as their r values are small.

Figure 2:
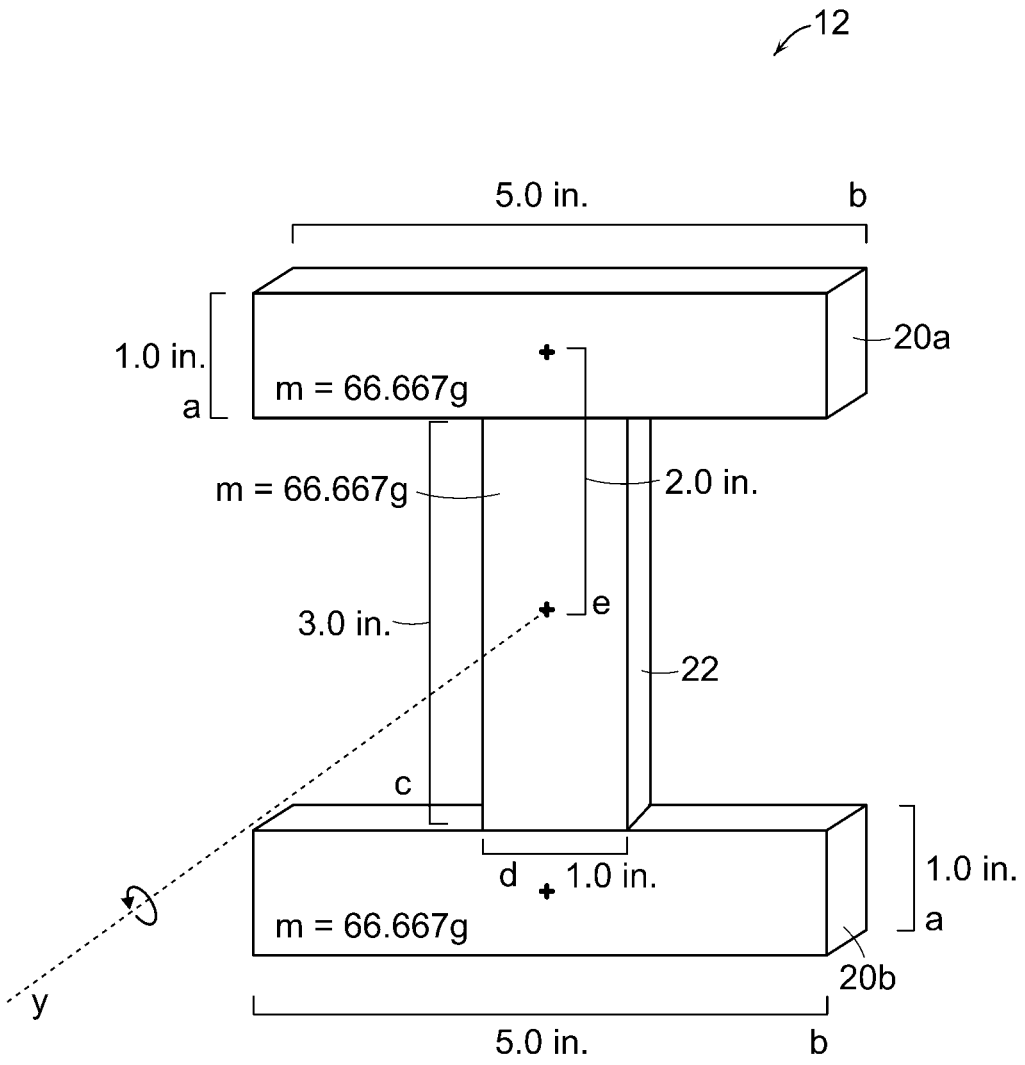
FIG. 2 is a top, perspective view of another idealized club head.

However, when the mass of the club head is concentrated in areas that are located farther away from the y-axis, their r values become bigger, resulting in increased moment of inertia. Like club head 10 of FIG. 1, idealized club head 12 of FIG. 2 has an overall length and width of 5 inches. The mass of club head 12 is 200.01 grams, nearly identical to that of club head 10, however club head 12 has an I-beam configuration. One weight member 22 having side c three inches in length, side d one inch in length, and a mass m of 66.67 grams is positioned between and perpendicular to two weight members 20*a* and 20*b* each having sides a one inch in length, side b five inches in length, and a mass m of 66.67 grams. The distance from the center of mass of weight member 20*a* or 20*b* to the center of mass of club head 12, which also serves as the point through which the y-axis runs, is called e, and is two inches in this case. The moment of inertia of the club head about the y-axis can be calculated by adding the moments of inertia of all three weight members, as is shown in the following equation:

$$I=2[(\tfrac{1}{12}\cdot m(a^2+b^2))+me^2]+\tfrac{1}{12}\cdot m(c^2+d^2)$$

This equation utilizes the Parallel Axis Theorem to determine the moments of inertia of weight members 20*a* and 20*b*. The moment of inertia of club head 12 is 877.78 g·in$^2$ or 5663.10 g·cm$^2$, resulting in a five percent increase in MOI over club head 10 of FIG. 1.

Figure 3:
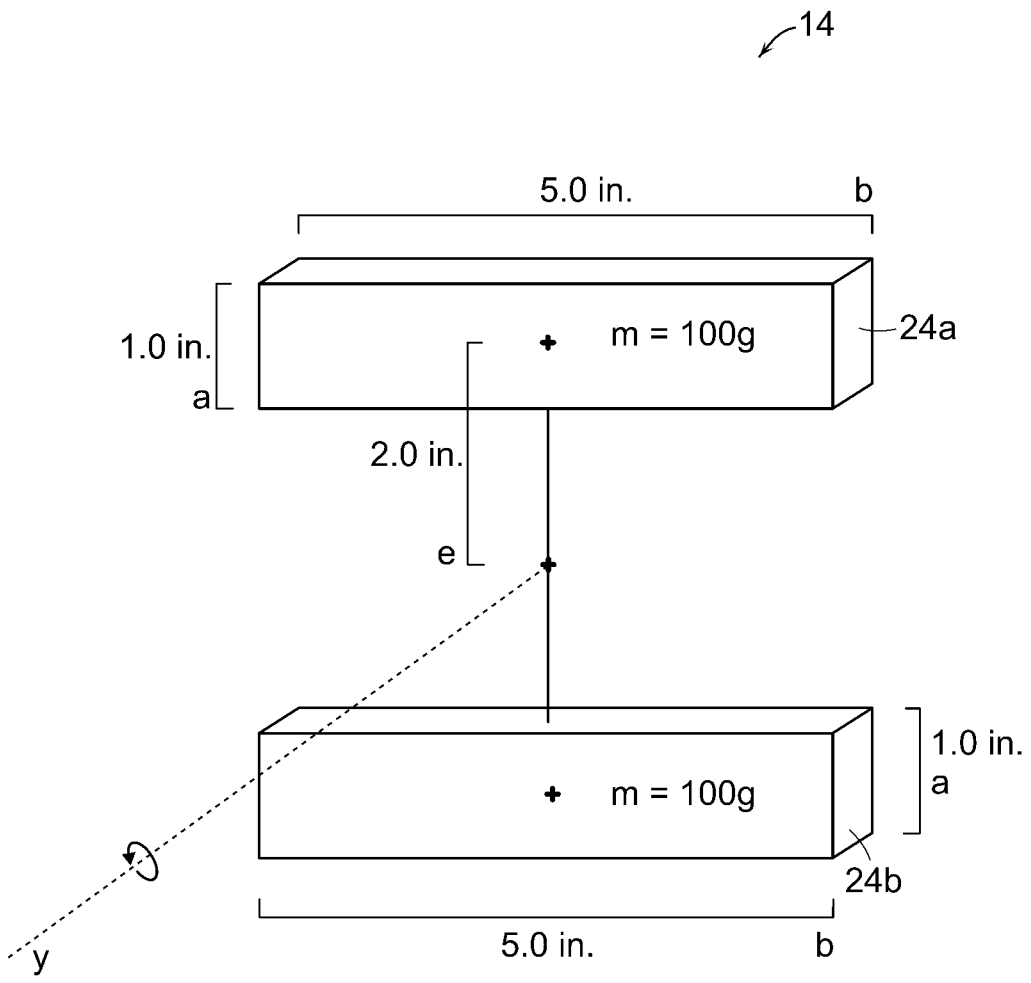
FIG. 3 is a top, perspective view of yet another idealized club head.

FIG. 3 shows another idealized club head 14, in which discrete weight members 24*a* and 24*b* are positioned around an axis of rotation. Because no weight member is located between weight members 24*a* and 24*b*, they are said to be arranged in a pseudo-I-beam configuration, as opposed to the I-beam configuration of FIG. 2. Club head 14 has an overall length and width of five inches and a total mass of 200 grams. Weight members 24*a* and 24*b* are five inches long and one inch wide, and each have a mass m of 100 grams. Weight members 24*a* and 24*b* are positioned three inches apart. As in FIG. 2, e is the distance from the center of mass of weight member 24*a* or 24*b* to the center of mass of club head 14 and the point through which the y-axis runs, and is two inches in this case. The moment of inertia of club head 14 can be described by this equation, which makes use of the parallel axis theorem:

$$I=2[(\tfrac{1}{12}\cdot m(a^2+b^2))+me^2]$$

In accordance with this equation, the MOI of club head 14 is 1233.33 g·in$^2$ or 7956.97 g·cm$^2$. This mass distribution offers a forty-eight percent increase in MOI over that of club head 10 of FIG. 1. When mass is allocated to areas located farther away from the axis of rotation, the r values of each point mass that makes up the entirety of the discrete weight member are large, resulting in much greater moment of inertia.

Figure 4A:
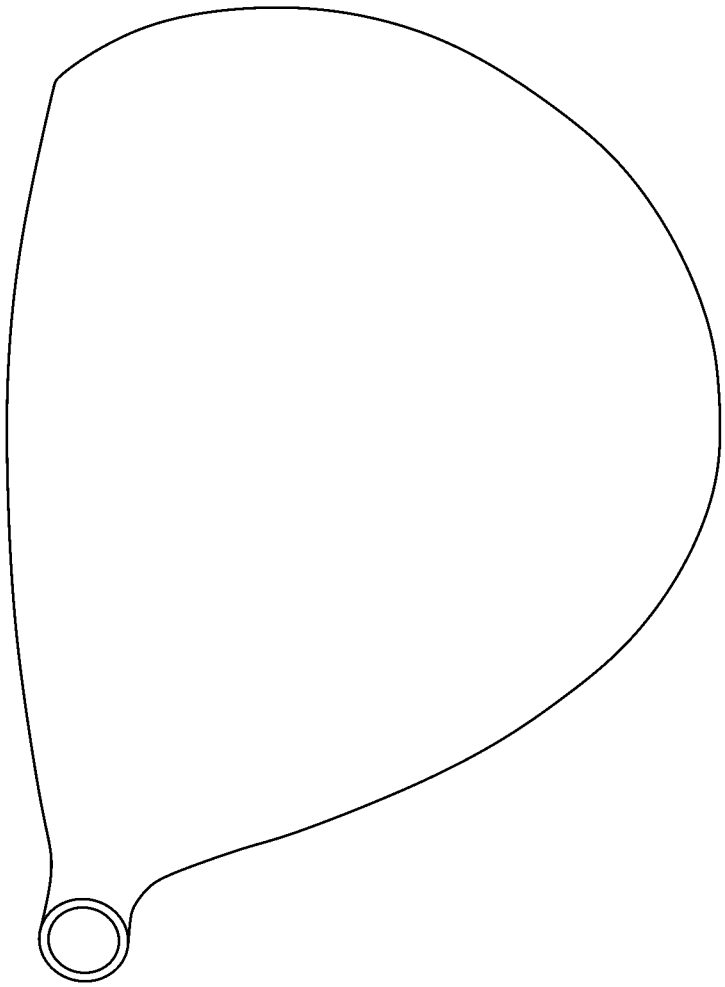
FIGS. 4*a-c* are top, bottom and side views, respectively, of an inventive club head.

The golf club head of the present invention utilizes the I-beam and pseudo-I-beam mass distribution patterns discussed above to optimize moment of inertia about an axis of rotation that runs vertically through the center of gravity or geometric center of the club head. In one embodiment of the present invention, shown in FIGS. 4*a*-4*c*, golf club head 16 comprises a face, crown, sole, skirt, and hosel, wherein the sole further comprises two discrete weight members 26 and 28. In accordance with this embodiment, weight member 28 is located substantially parallel to and toward the face edge of sole 30 and is substantially centered between the toe and heel. Weight member 28 can have a rectangular shape. Preferably, weight member 28 is located between about 1.0 and 4.0 cm from the face edge of sole 30.

Sole 30 of golf club head 16 also includes weight member 26, located toward the back edge of sole 30 and substantially centered with respect to the toe and heel of sole 30. Weight member 26 may located between about 0.1 and 1.5 cm from the back edge of sole 30. Preferably, the back edge weight member 26 has a shape that substantially resembles the shape of the back edge of sole 30. The overall shape of weight member 26 may be substantially triangular or tetrahedral. Alternatively, weight member 26 may comprise the back edge and a portion of the inner area of sole 30.

Both weight members 26 and 28 may have a greater density and same thickness or same density and greater thickness than other areas of sole 30. Weight members 26 and 28 may be comprised of a weight member disposed on the surface of sole 30 or installed flush with sole 30. Said weight member may comprise tungsten, iron, stainless steel, or any other suitable material. Alternatively, weight members 26 and 28 may be comprised of the material comprising other areas of sole 30, however having a greater thickness than other areas of sole 30.

Figure 4B:
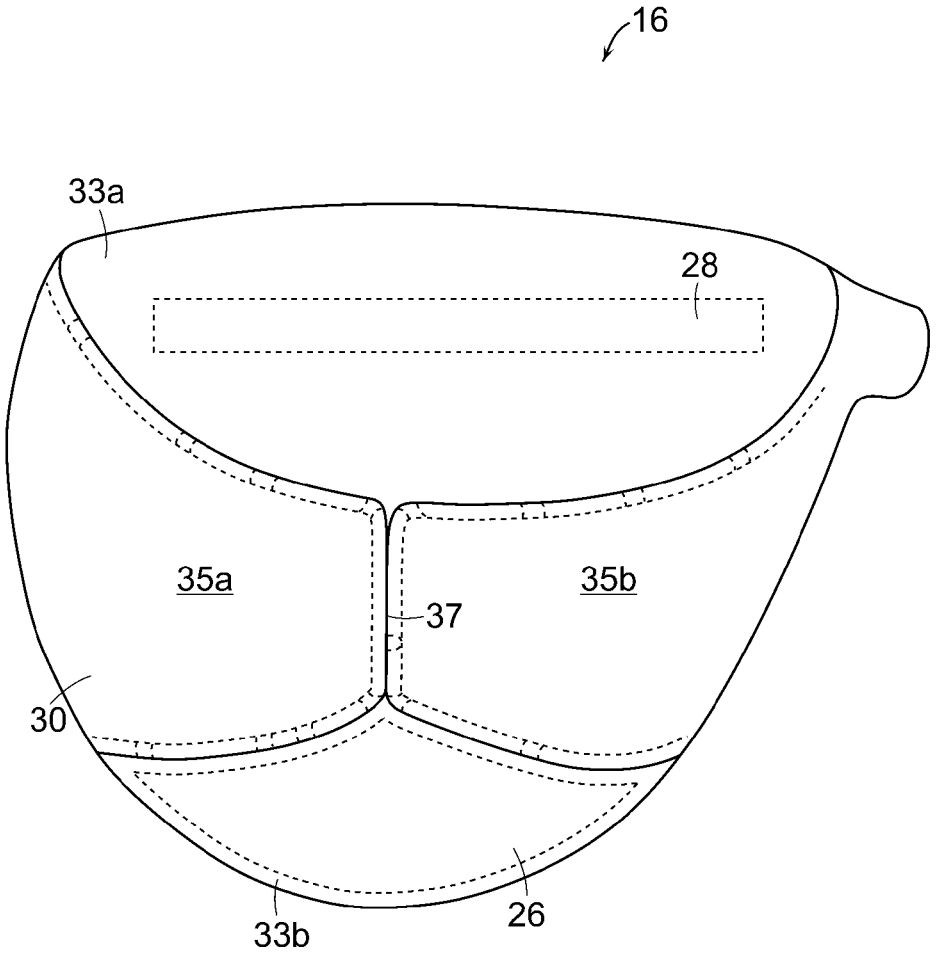
Figure 4C:
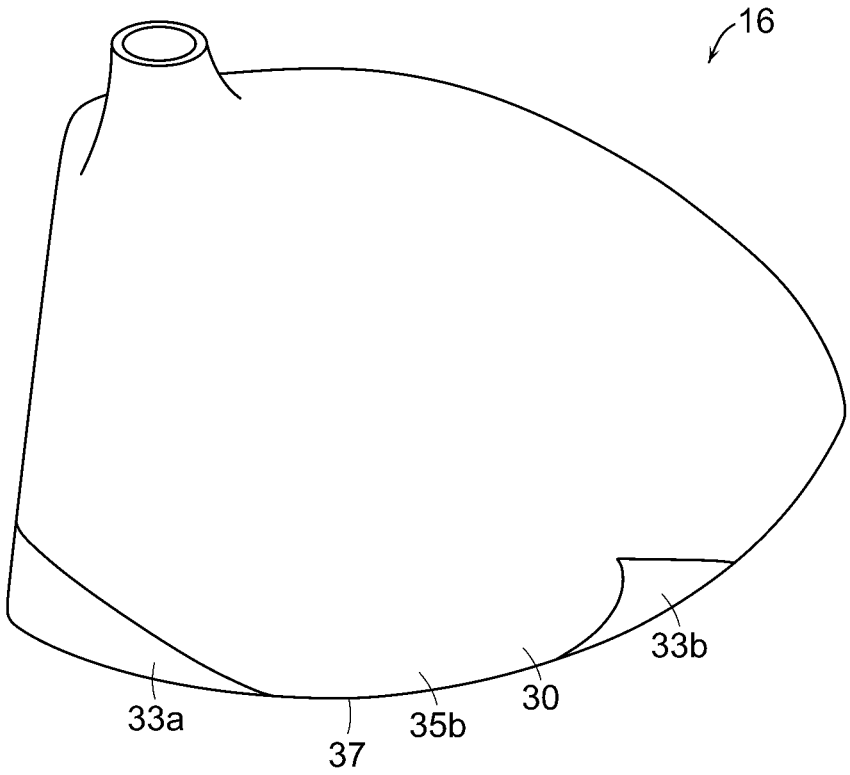

In accordance with this embodiment of the present invention, sole 30 is further comprised of four sections, 33*a* and 33*b* and 35*a* and 35*b*. Section 33*a* comprises the area of sole 30 beginning at the face edge and continuing back approximately one-third of the length of the sole. Section 33*a* extends along the length of the face edge of sole 30 and may have a substantially oval shape or a substantially rectangular shape. Preferably, weight member 28 is located within section 33*a*. Section 33*b* begins at the back edge of sole 30 and extends toward the face edge about one-third of length of sole 30. Weight member 26 may be located within section 33*b*. Alternatively, the whole of section 33*b* may be comprised of weight member 26. Rib 37 connects section 33*a* to section 33*b*. In the embodiment shown in FIG. 4*b*, rib 37 is narrow. In accordance with the invention, rib 37 may have a greater width. In particular, rib 37 may have a width of about 1.0 millimeter to about 10.0 millimeters. Section 35*a* is located between sections 33*a* and 33*b*, having one edge at rib 37 and extending to the toe edge of sole 30. Preferably, the material of section 35*a* is continuous with the material of the skirt of golf club head 16, having no distinct border or edge at the toe edge of sole 30. Like section 35*a*, section 35*b* is positioned between sections 33*a* and 33*b* and has one edge at rib 37. Section 35*b* extends to the heel edge of sole 30. Preferably, the material of section 35*b* is continuous with the material of the skirt, having no distinct border or edge at the heel edge of sole 30. Alternatively speaking, section 35*a* and 35*b* may be classified as a "non-weighted section"; A "non-weighted section" is specifically defined to mean, in this or any other embodiment, a portion of the sole of the golf club head that that does not contain any additional weight or additional thickness. As the material of the skirt is preferably continuous with the material of sections 35*a* and 35*b*, the skirt has the appearance of wrapping around the underside of golf club head 16. The material of the skirt may also be continuous with the material of the crown, giving the appearance of a single piece of material wrapping around the sole, heel and toe sides, and crown of golf club head 16. Viewing sole 30 from the bottom plan vantage point of FIG. 4*b*, sections 35*a* and 35*b* may be depressed with respect to sections 33*a* and 33*b* and rib 37, such that at address position, sections 35*a* and 35*b* do not meet the ground. Further, sole 30 is curved such that the portion proximal the face edge and the portion proximal to the back do not meet the ground when club head 16 is at address position, to provide ground clearance during the swing. This design minimizes the surface area of the sole in contact with the ground during the swing, and hence minimizes the potential for bouncing or digging the club head into the ground. The transitions between the edges of section 33*a*, section 33*b* and rib 37 and depressed sections 35*a* and 35*b* are preferably sloping transitions, as illustrated in FIG. 4*b*. Sections 35*a* and 35*b* may comprise composite or lightweight metals such as titanium or aluminum.

Figure 5A:
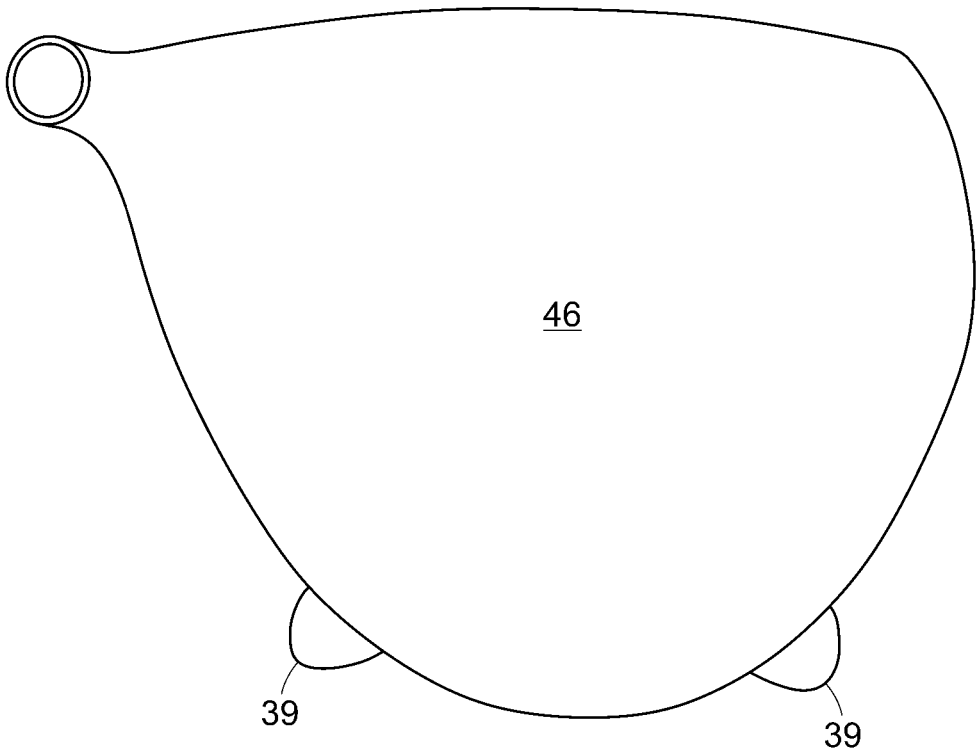
FIGS. 5*a-c* are top, bottom and side views, respectively, of another inventive club head.
Figure 5B:
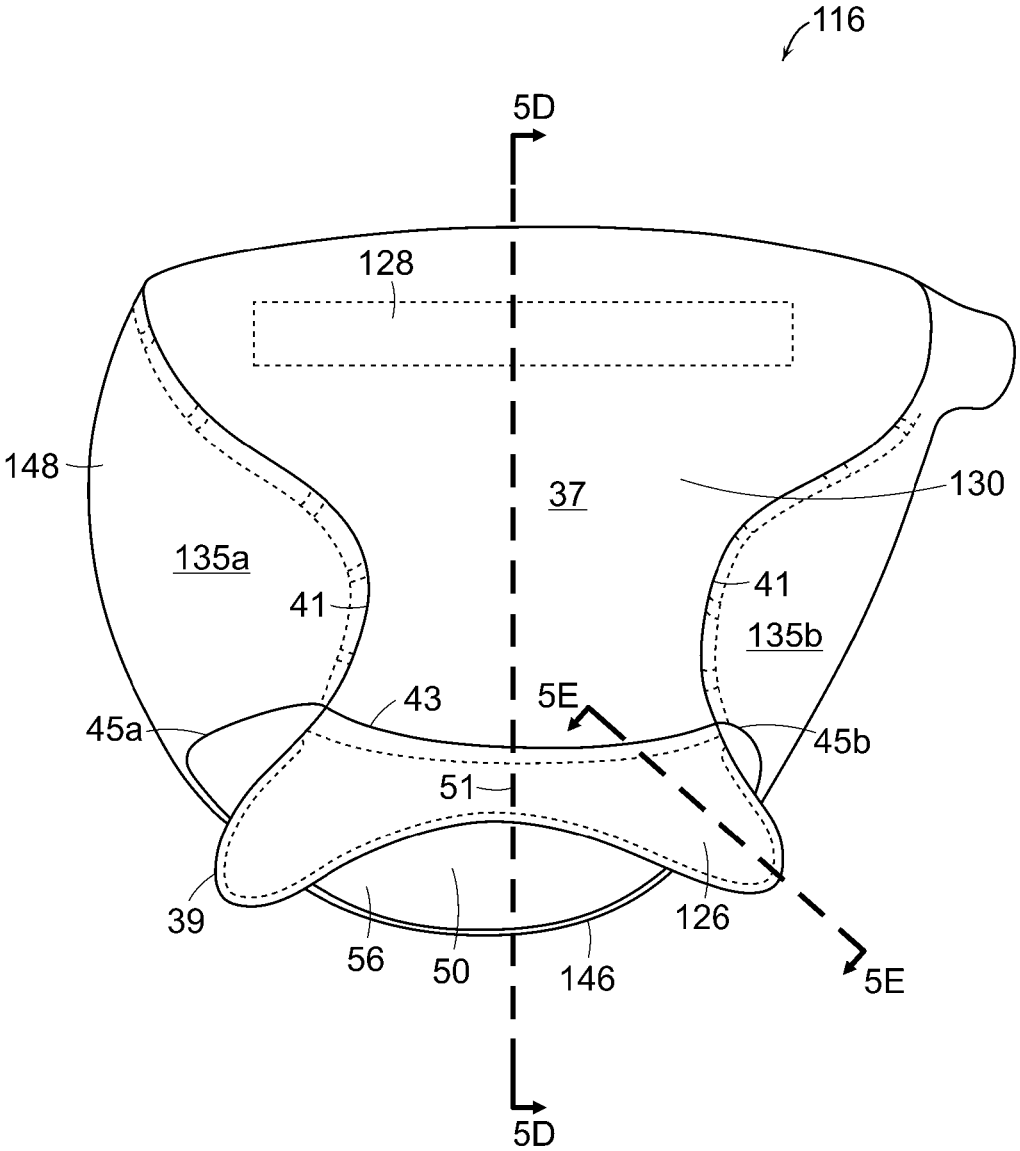
Figure 5C:
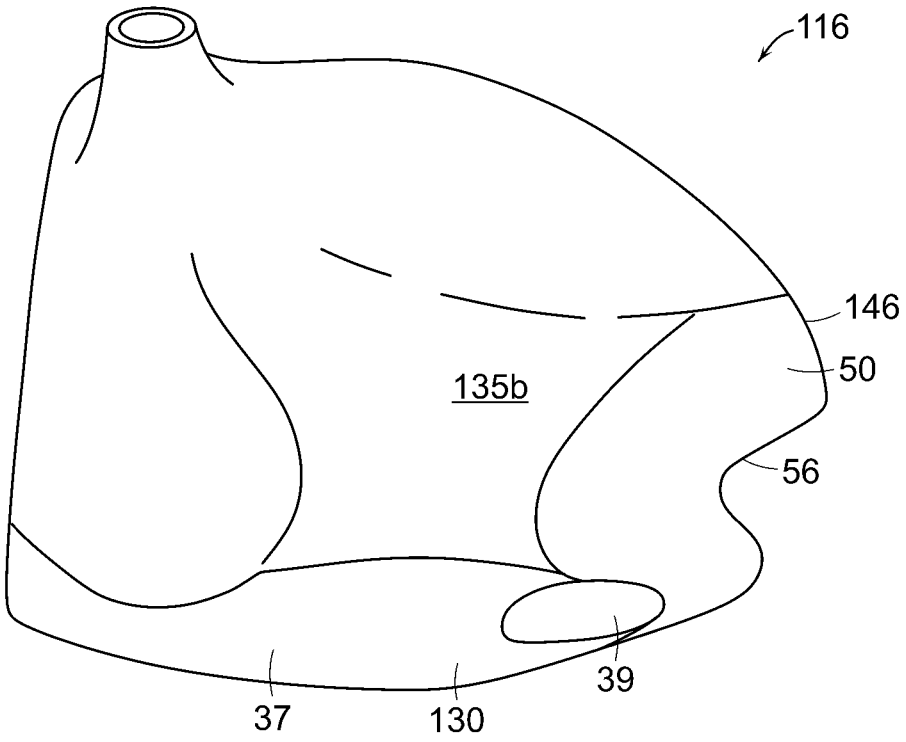

In another embodiment of the present invention, as shown in FIGS. 5*a-c*, golf club head 116 comprises a face, crown, sole, skirt, and hosel, wherein the sole further comprises two discrete weight members 126 and 128. The sole is further divided into four sections, sections 135*a* and 135*b*, section 37 and section 39. Section 37 has one edge coinciding with and extending the length of the face edge of sole 130. Section 37 extends back toward the back edge of sole 130, tapering first slightly as it extends away from the face edge and then tapering significantly to form waist 41. Section 37 flutes slightly as it extends from waist 41 to terminating edge 43. Weight member 128 is located within section 37 and is substantially parallel with the face edge of sole 130. Weight member 128 substantially centered between the toe edge and heel edge of sole 130. Weight member 128 can have a rectangular shape. Preferably, weight member 128 is located between about 1.0 and 4.0 cm from the face edge of sole 130. Section 135*a* extends from the toe-proximal edge of section 37 to the toe edge of sole 130. Preferably, the material of section 135*a* is continuous with the material of the skirt of golf club head 116 so that section 135*a* has no distinct border or edge at the toe edge of sole 130. Section 135*a* has terminating edge 45*a*. As terminating edge 45*a* does not connect to a skirt, it defines one edge of cavity 50. Likewise, section 135*b* extends from the heel-proximal edge of section 37 to the heel edge of sole 130. Terminating edge 45*b* of section 135*b* does not connect to a skirt and so defines one edge of cavity 50. The material of section 135*b* is preferably continuous with the material of the skirt so that no border or edge of section 135*b* is present at the heel edge of sole 130. As in the embodiment illustrated in FIGS. 4*a-c*, sections 135*a* and 135*b* may be depressed with respect to sections 37 and 39. The sloping transition from section 37 to sections 135*a* and 135*b* is shown in FIG. 5*b*. Sections 135*a* and 135*b* may comprise composite or lightweight metals such as titanium or aluminum.

A final section 39 of sole 130 is preferably attached to and extends from the back-edge of section 37. Preferably, the sides and back-edge of section 39 are not attached to any part of sole 130 or golf club head 116, causing section 39 to appear as projecting from section 37. Further, section 39 is preferably bow-shaped, having a back-edge that curves toward sole 130.

As mentioned above, sole 130 includes weight members 128 and 126. Weight member 128 is preferably located in section 37 proximal to and parallel with the face edge of sole 130 and is similar to weight member 28 in golf club head 16. Weight member 126 is similar to weight member 26 in golf club head 16 in all respects except for shape and position. Weight member 126 may be located in section 39 and may have a shape that substantially resembles the shape of section 39. Alternatively, weight member 126 can comprise the entirety of section 39.

Figure 5D:
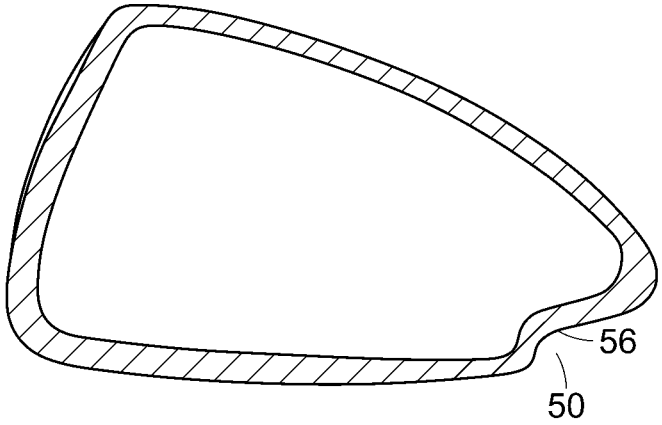
FIG. 5*d* is a cross-sectional view of the club head of FIGS. 5*a-c* along line A-A.
Figure 5E:
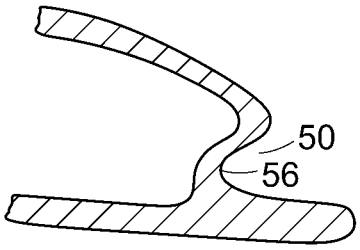
FIG. 5*e* is a cross-sectional view of the club head of FIGS. 5*a-c* along line B-B.

Club head 116 includes cavity 50, formed between crown 146 and sole 130 and having inner wall 56. Cavity 50 has one opening located at the back of club head 116 having edges that coincide with terminating edges 45*a* and 45*b* of sections 135*a* and 135*b*, respectively, and with the back edge of crown 146 and the sides and back edge of section 39. Cavity 50 is relatively shallow, as is illustrated in FIGS. 5*d* and 5*e*, showing cross-sectional views along line AA and line BB, respectively. Inner wall 56 defines the terminus of cavity 50.

In a variation of the above-described embodiment, weight member 126 can be separated at narrow section 51 to create two discrete weight members in section 39 of sole 130.

Figure 6A:
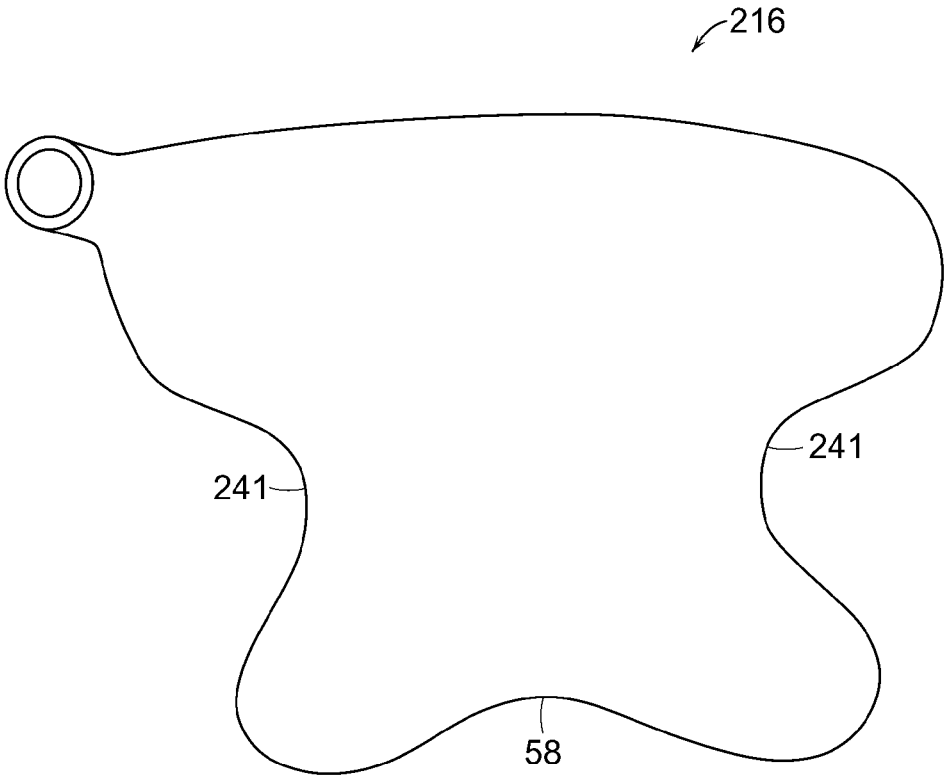
FIGS. 6*a-c* are top, bottom and side views, respectively, of yet another inventive club head.
Figure 6B:
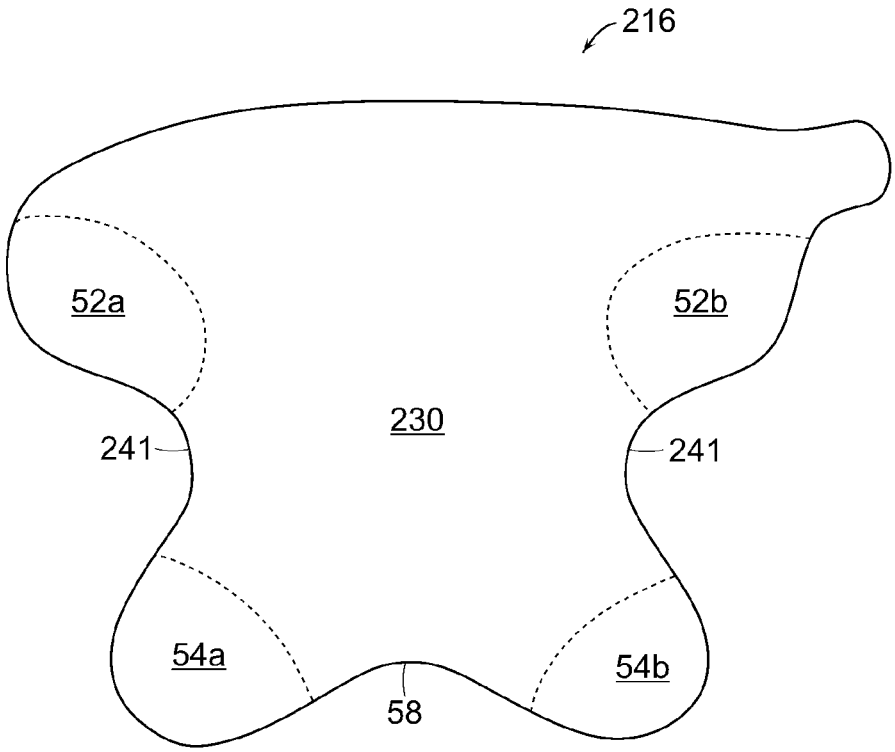
Figure 6C:
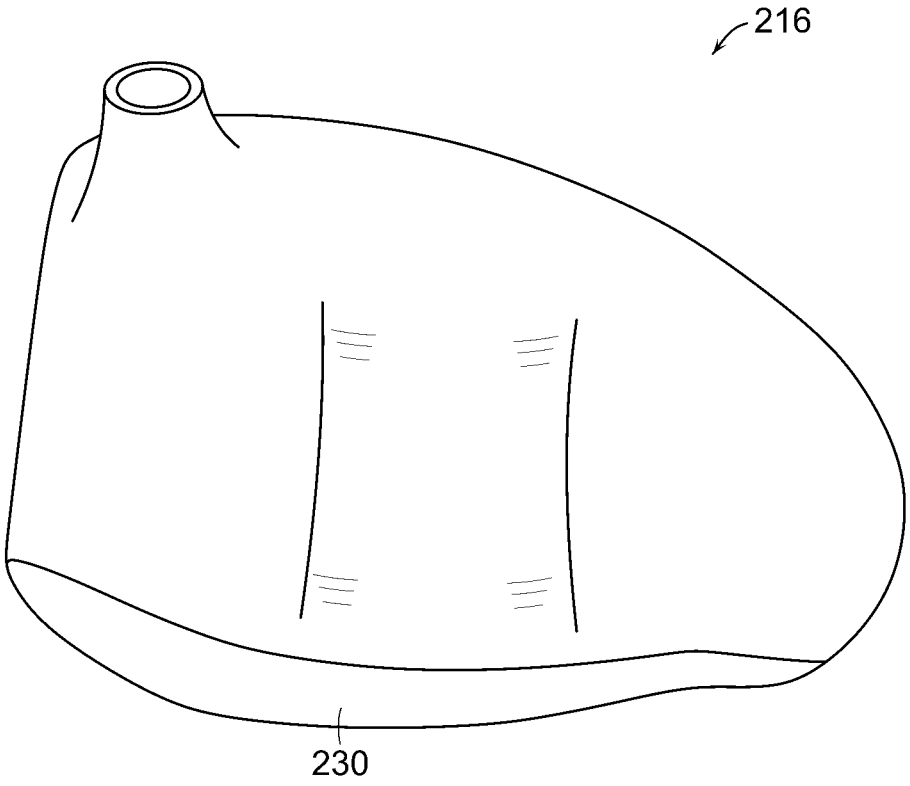

Another embodiment of the present invention is illustrated in FIGS. 6*a-c*, wherein golf club head 216 comprises a face, crown, sole, skirt, and hosel. Sole 230 further comprises four discrete weight members 52*a*, 52*b*, 54*a* and 54*b*. In accordance with this embodiment of the present invention, club head 216 narrows at waist 241. Further, back 58 is bow-shaped, having an edge that curves toward the hitting face of club head 216. This configuration releases material from the central areas of the club head and concentrates mass toward the perimeters of the club head, optimizing the moment of inertia of the club head. Weight member 52*a* is preferably located at the toe edge of sole 230 between the face edge and waist 241. Weight member 52*b* is preferably located at the heel edge of sole 230 between the face edge and waist 241. Weight member 54*a* is preferably located at the toe edge of sole 230 and adjacent to back 58. Weight member 54*b* is preferably located at the heel edge of sole 230 and adjacent to back 58. Weight members 52*a*, 52*b*, 54*a* and 54*b* may be round or curved or may have any suitable shape. Weight members 52*a*, 52*b*, 54*a* and 54*b* are similar to weight members 26 and 28 of FIG. 4*b* in that they may have a greater density or thickness than other areas of sole 230. They may be comprised of a weight member disposed to the surface of sole 230 or installed flush with sole 230. Said weight members may comprise tungsten, iron, stainless steel, or any other suitable high-density material. Alternatively, weight members 52*a*, 52*b*, 54*a* and 54*b* may be comprised of the material comprising other areas of sole 230, however having a greater thickness than other areas of sole 230.

Figure 7A:
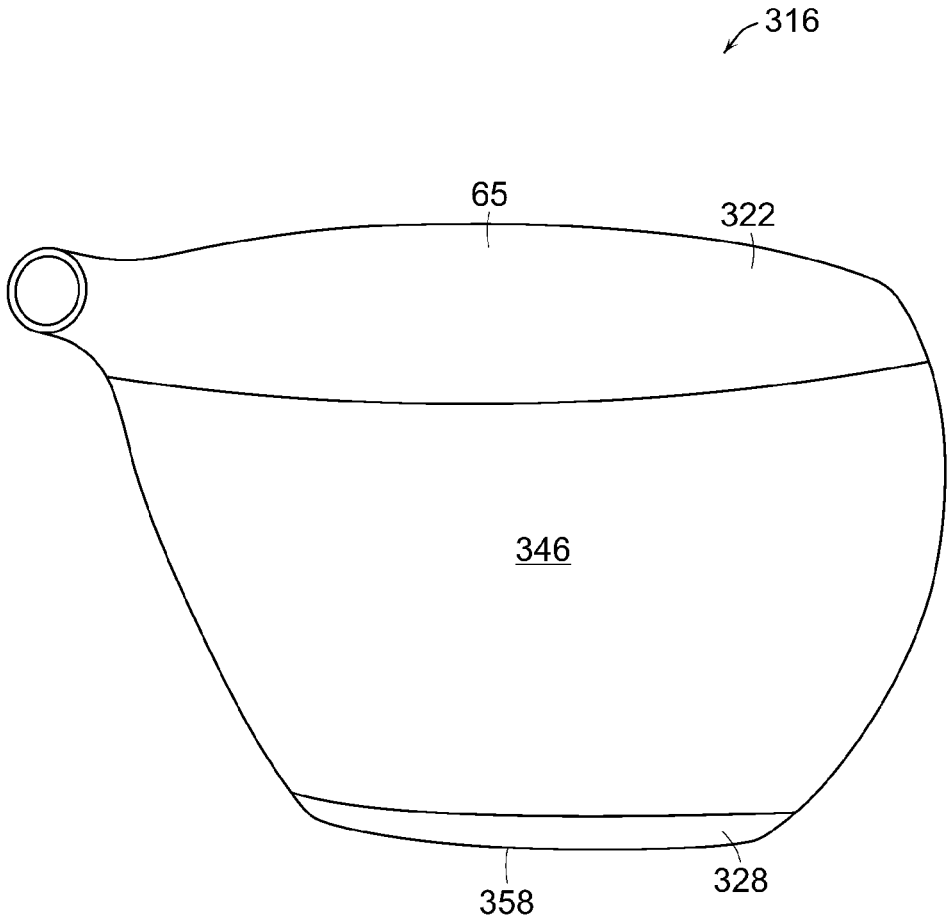
FIGS. 7*a-d* are top, bottom, side and back views, respectively, of yet another inventive club head.
Figure 7B:
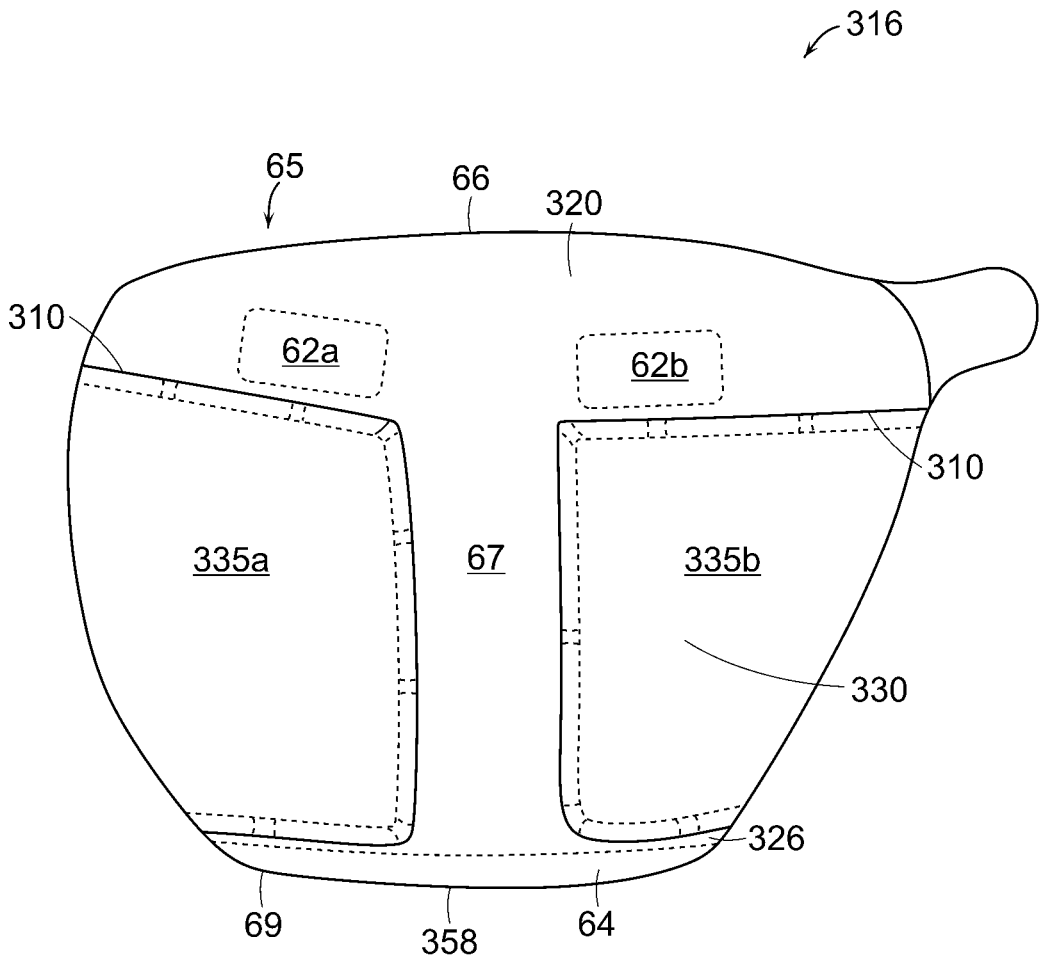
Figure 7C:
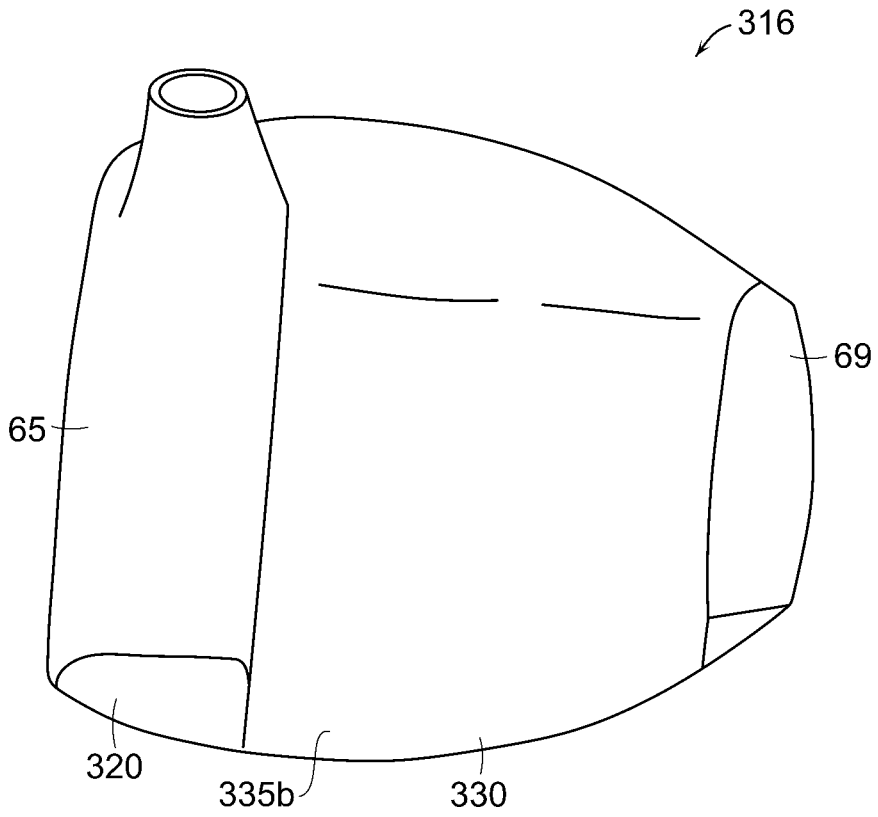
Figure 7D:
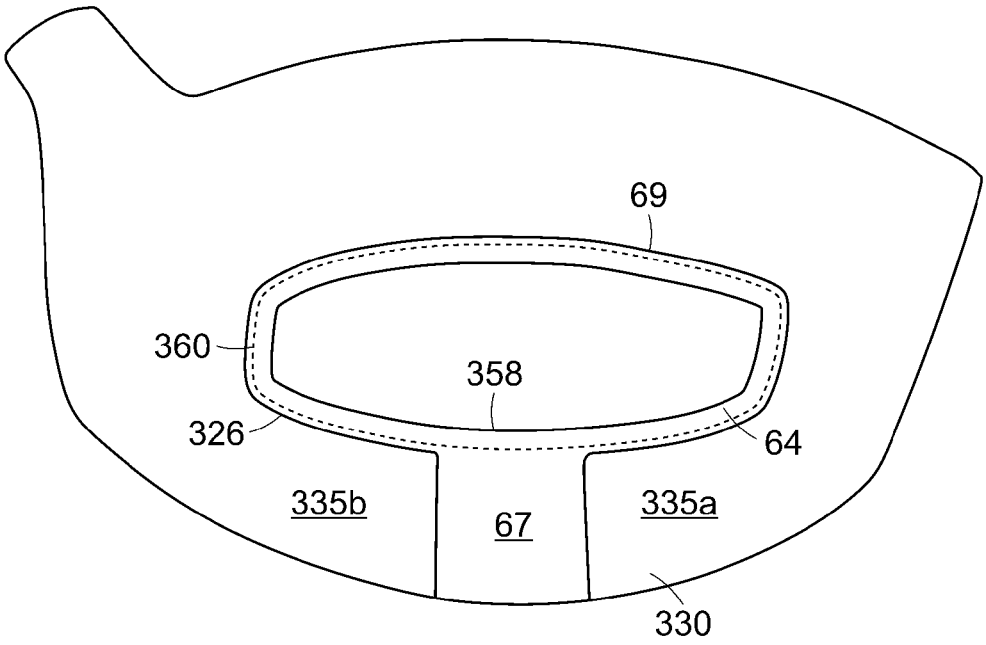

In yet another embodiment of the present invention, shown in FIGS. 7*a-c*, golf club head 316 comprises a face, crown, sole, skirt and hosel. Golf club head 316 further comprises hitting cup 65, which includes hitting face 66, sole portion 320, crown portion 322, skirt toe portion 324 and skirt heel portion 326; and aft cup 69, which includes back 358, sole portion 326 and crown portion 328. Hitting cup 65 and aft cup 69 are connected via bridge 67, which is substantially centered with respect to the toe edge and heel edge of sole 330. Hitting cup 65, aft cup 69 and bridge 67 preferably comprise lightweight metal. More preferably, hitting cup 65, aft cup 69 and bridge 67 comprise titanium or aluminum. The remaining portion of sole 330 not comprising hitting cup 65, aft cup 69 and bridge 67 is divided into two sole sections, section 335*a* and section 335*b*. Section 335*a* is located between the toe edge of sole 330, hitting cup 65, bridge 67 and aft cup 69. Section 335*b* is located between the heel edge of sole 330, hitting cup 65, bridge 67 and aft cup 69. As in previous embodiments, sections 335*a* and 335*b* may be depressed with respect to sole portion 320, bridge 67 and sole portion 326. As shown in FIG. 7*b*, a sloping transition exists between the edges of sole portion 320, bridge 67 and sole portion 326 and sections 335*a* and 335*b*. Preferably, section 335*a* and section 335*b* comprise lightweight materials. More preferably, sections 335*a* and 335*b* comprise composite.

In accordance with this aspect of the present invention, sole 330 includes three discrete weight members. Sole portion 320 comprises two discrete weight members 62*a* and 62*b*. Weight member 62*a* is preferably located adjacent to edge 310 and between the center of sole portion 320 and the toe edge of sole 330. Weight member 62*b* is preferably located adjacent to edge 310 and between the center of sole portion 320 and the heel edge of sole 330. Weight members 62*a* and 62*b* are similar with respect to material composition to weight members 26 and 28 of FIG. 4*b* and can be connected to each other. Aft cup 69 includes weight member 64, which preferably spans the length of back edge 358. Weight member 64 may comprise tungsten, stainless steel or other high-density metals and disposed to the surface of sole portion 326, may be installed flush with sole portion 326 or may comprise the same material as sole portion 326 but having a greater thickness than the remainder of sole portion 326. Alternatively, weight member 64 may be disposed to the surface of sole portion 326 and to the surface of back skirt 360.

Figure 8A:
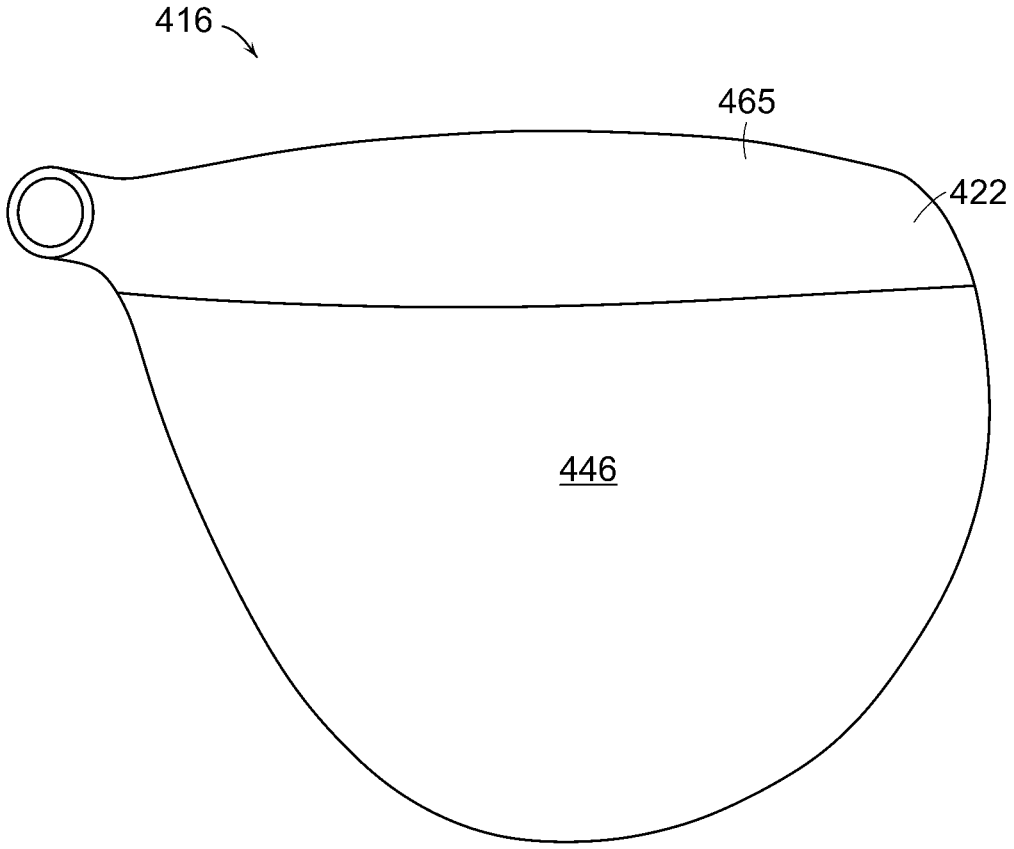
FIGS. 8*a-d* are top, bottom, side and back views, respectively, of another inventive club head.
Figure 8B:
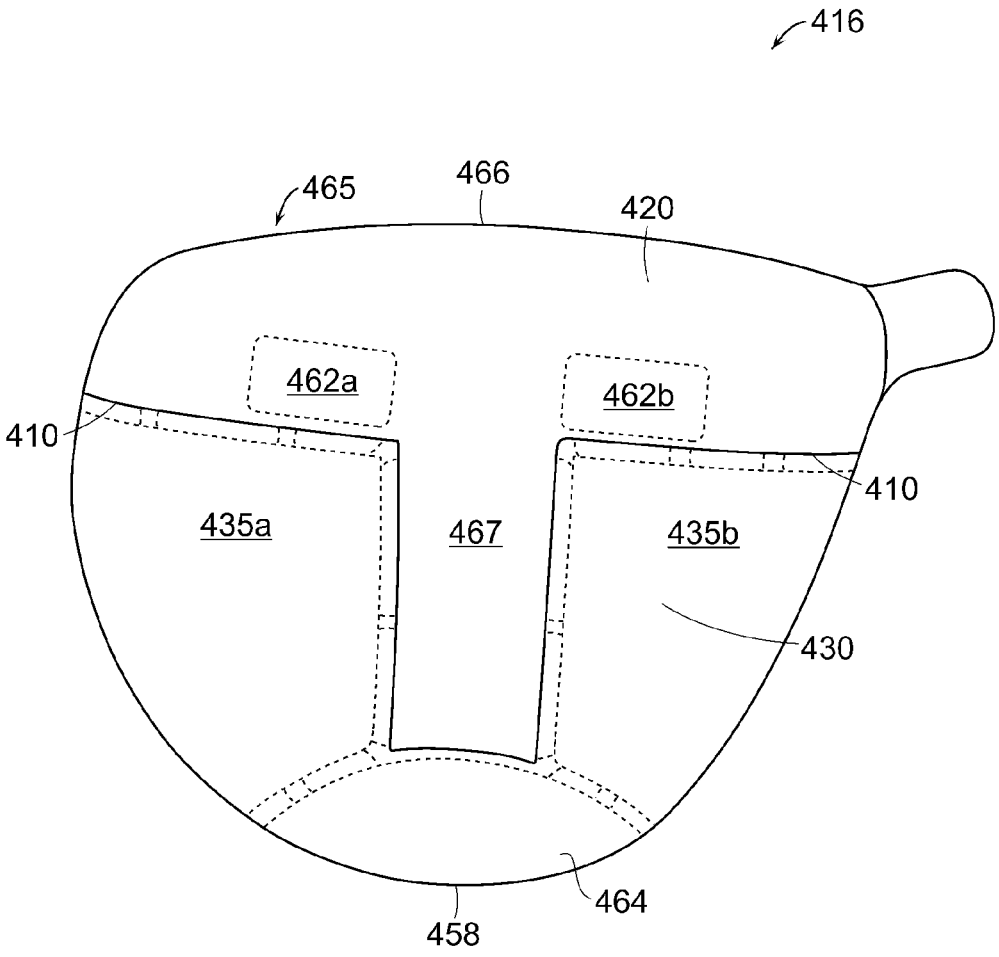
Figure 8C:
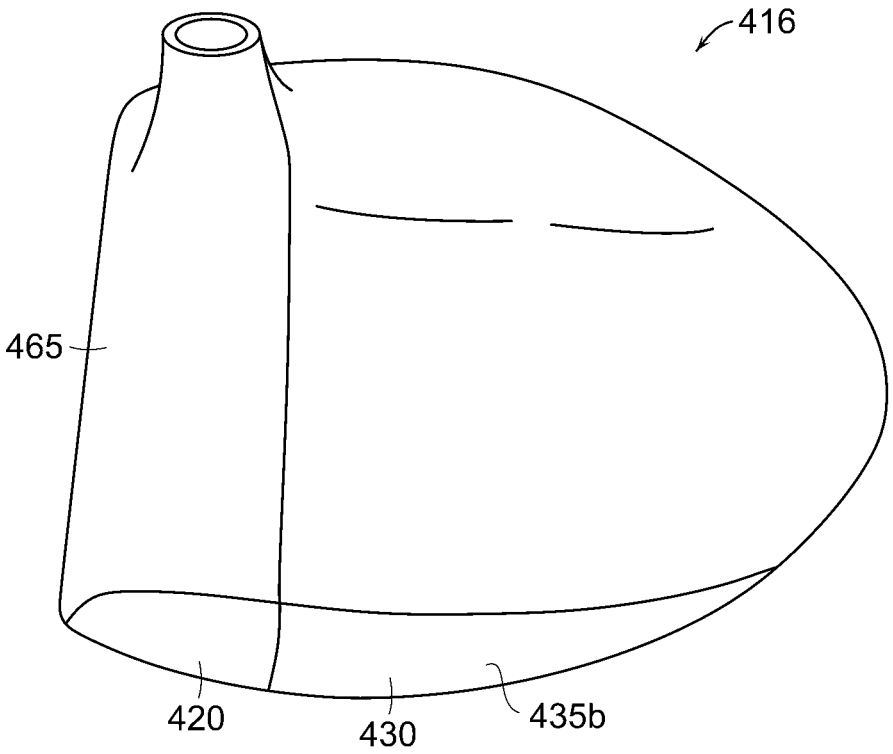
Figure 8D:
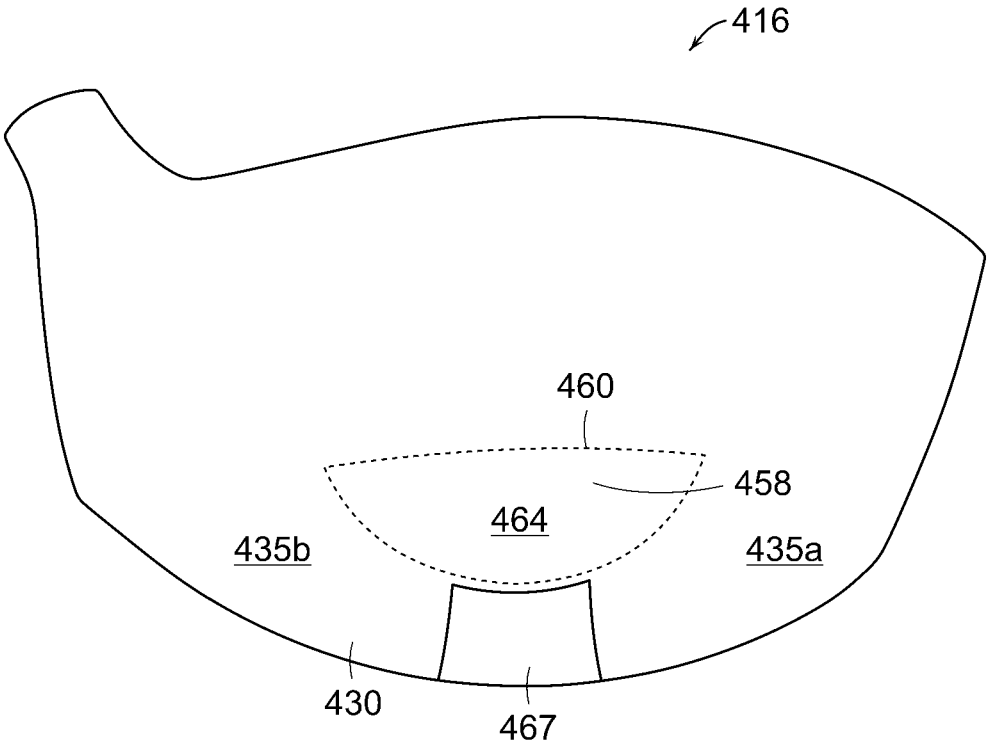

In a final embodiment of the present invention, shown in FIGS. 8*a*-8*c*, golf club head 416 is similar to club head 316 of FIGS. 7*a-c*, however the club head of the present embodiment does not include an aft cup. Club head 416 comprises a face, crown, sole, skirt and hosel, and further comprises hitting cup 465. Hitting cup 465 comprises sole portion 420, face 466, crown portion 422, skirt toe portion 424 and skirt heel portion 426. Preferably, hitting cup 465 comprises a lightweight metal. More preferably, hitting cup 465 comprise titanium.

Two weight members 462*a* and 462*b* are located in sole portion 420. Weight members 462*a* and 462*b* are identical to weight members 62*a* and 62*b* of FIG. 7*b* with respect to location on the sole, composition and installation on or within the sole. Sole 430 also includes weight member 464, located adjacent to back edge 458. Weight member 464 may be disposed to the surface of sole 430 and may comprise tungsten, stainless steel or other high-density metals, or may be made of the same material as other areas of sole 330 however having a greater thickness than those areas. Alternatively, weight member 464 may be disposed to the surface of sole 430 and to the surface of skirt back 460. Bridge 467 connects hitting cup 465 and weight member 464 and is substantially centered between the toe edge and heel edge of sole 430. Bridge 467 preferably comprises lightweight metal but more preferably comprises titanium. The remaining area of sole 430 comprises two sections, section 435*a* and 435*b*. Section 435*a* is located between the toe edge of sole 430, hitting cup 465, bridge 467 and weight member 464 and preferably comprises a lightweight material, but more preferably comprises composite. Section 435*b* is located between the heel edge of sole 430, hitting cup 465, bridge 467 and weight member 464 and preferably comprises a lightweight material, but more preferably comprises composite Like the embodiment illustrated in FIGS. 7*a-c*, sections 435*a* and 435*b* may be depressed with respect to sole portion 420, bridge 467 and the portion of sole 430 comprising weight member 464. FIG. 8*b* shows the sloping transition between the edges of sole portion 420, bridge 467 and the portion of sole 430 comprising weight member 464 and depressed sections 435*a* and 435*b*.

While various descriptions of the present invention are described above, it should be understood that the various features of each embodiment could be used alone or in any combination thereof. Therefore, this invention is not to be limited to only the specifically preferred embodiments depicted herein. Further, it should be understood that variations and modifications within the spirit and scope of the invention might occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

We claim:

1. A golf club head comprising a face, crown, skirt, hosel and sole, wherein the sole comprises at least a first weight member, a second weight member, and a non-weighted section;

wherein the first weight member is located toward and substantially parallel to the face edge of the sole and is substantially centered between a toe edge and a heel edge of the sole, and wherein the second weight member is located toward a back edge of the sole and is substantially centered between the toe edge and heel edge of the sole, wherein the first and second weight members are two distinct weight members, wherein the non-weighted section completes the remainder of the sole, wherein the first and second weight members have a higher density than the non-weighted section of the sole or have a higher thickness than the non-weighted section of the sole to increase the moment of inertia of the golf club head, further comprising a cavity formed between the crown and the sole, and wherein the cavity forms a protrusion extending out from the skirt of the golf club head, wherein the sole further comprises four sections, wherein a first section has an edge coinciding with the entire face edge of the sole and which tapers as it extends back toward the back edge of the sole forming a waist and which then flutes slightly at its terminating edge, and wherein a second section has a bow-shape and a first edge coinciding and connecting with the terminating edge of the first section and a second edge that extends off of the sole to form the back edge of the sole such that a plurality of extremities of the bow-shaped second section extend beyond the terminal end of the crown of the golf club head to form the cavity between the crown and the sole, and wherein a third section comprises the area between the toe edge of the sole and the first section and which has a terminating edge that comprises a portion of the edge of said cavity, wherein a fourth section comprises the area between the heel edge of the sole and the first section and which has a terminating edge that comprises a portion of the edge of said cavity wherein the third and fourth sections are depressed with respect to the first and second sections such that the sole has a varied elevation, and wherein the first weight member is located only within the first section, while the second weight member is located only within and comprises the entirety of the second section.

2. The golf club head of claim 1, wherein the third and fourth sections comprise the same material as the skirt and crown and wherein no ornamental or structural seams exist between said sections and skirt and crown.

* * * * *